US005593063A

United States Patent [19]

Claydon et al.

[11] Patent Number: 5,593,063

[45] Date of Patent: Jan. 14, 1997

[54] DEFORMABLE END WALL FOR A PRESSURE-RESISTANT CONTAINER

[75] Inventors: Paul C. Claydon; Neil D. McMahon, both of Oxfordshire, United Kingdom

[73] Assignee: Carnaudmetalbox plc, United Kingdom

[21] Appl. No.: 373,204

[22] PCT Filed: Jul. 13, 1993

[86] PCT No.: PCT/GB93/01457

§ 371 Date: Jan. 10, 1996

§ 102(e) Date: Jan. 10, 1995

[87] PCT Pub. No.: WO94/03367

PCT Pub. Date: Feb. 17, 1994

[30] Foreign Application Priority Data

Jul. 30, 1992 [GB] United Kingdom ..... 9216247

[51] Int. Cl.[6] ..... B65D 7/42

[52] U.S. Cl. ..... 220/608; 220/609

[58] Field of Search ..... 220/608, 609, 220/606, 623, 624

[56] References Cited

U.S. PATENT DOCUMENTS

| | | | |
|---|---|---|---|
| 3,693,828 | 9/1972 | Kneusel et al. | 220/608 |
| 3,905,507 | 9/1975 | Lyu | 220/608 |
| 4,010,867 | 3/1977 | Jones | 220/608 |
| 4,048,934 | 9/1977 | Wallace | 220/608 |
| 4,249,666 | 2/1981 | Hubert et al. | 220/608 |

*Primary Examiner*—Joseph Moy
*Attorney, Agent, or Firm*—Diller, Ramik & Wight, PC

[57] ABSTRACT

An end wall for a can body has a central panel (7) surrounded by a conventional expansion ring (8) which is connected to an inner wall (16) of a channel portion by an upwardly extending deformable annulus (17, 18) so that during thermal processing of a closed can having this end wall, the deformable annulus changes shape to permanently increase the container volume. The deformable annulus protects the side wall and ends of the can from excessive pressure so thinner container materials may be used.

18 Claims, 4 Drawing Sheets

DEFORMABLE END WALL FOR A PRESSURE-RESISTANT CONTAINER

This invention relates to metal containers and more particularly but not exclusively to the bottom wall of a container drawn from a circular blank to comprise a bottom wall and a side wall upstanding from the periphery of the bottom wall.

A widely used container for petfoods, typically 73 mm diameter by 56 mm tall comprises a substantially flat center panel surrounded by a flexible annulus which is joined to a channel portion, or stand bead, having an inner wall joining the flexible annulus and an outer wall joining the side wall of the container. The containers are usually drawn from a laquered steel such as electrochrome coated steel or tinplate in temper DR8 of thickness 0.17 mm (about 0.007"). The side wall of this can is vulnerable to damage at point of sale. When the containers are filled, the closing machine applies a top pressure to a can end while a double seam is rollformed to join the can end to the side wall, so the side wall has to be strong enough to support this top load. When the closed containers are thermally processed the contents of the can expand so pressure develops in the container and the side wall is protected from undue distortion because the flexible annulus permits the bottom wall to bulge outwardly to increase the container volume. As the container cools, the pressure in the can abates. If the product is hot filled, a partial vacuum may develop in the container when cooled to room temperature so putting the side wall at risk of collapse unless the flexible annulus returns towards original shape.

Can ends which provide the desired expansion and contraction in container volume by simple flexure are described in U.S. Pat. Nos. 3,105,765 (Creegan) and 3,409,167 (Blanchard), and in British Patents Publications 2107273 and 2119743 (of American Can Company) but in all these patents the change of volume available in a filled and closed can is limited to that available from flexure, not permanent change of shape.

These volume change requirements are made more stringent if tall cans having a wall ironed side wall are used because the side wall may be between 0.075 mm (0.004") and 0.0125 mm (0.005").

A first objective of this invention is to provide a container having an end wall which will provide an increased volume during thermal treatment to reduce the pressures generated within the can during thermal processing. A second objective is to provide some flexibility to compensate for a residual partial vacuum in a filled and closed can. The end wall may be integral with the side wall of a drawn can body or alternatively the end wall may be a can end or lid.

Accordingly, this invention provides a container end wall comprising a peripheral channel portion, or cover hook an inner wall of which supports a center panel, wherein a deformable annulus extends both radially and axially inwards away from the inner wall to support a dependent annulus which connects the center panel to the deformable annulus, characterised in that when subjected to pressure inside a container, after closure, the central panel is temporarily deflected axially outwards and the deformable annulus is permanently deflected from its initial stable position to its second stable position to increase the volume of the container.

In one embodiment, the deformable annulus comprises a substantially flat annular portion which extends radially inwards from the inner wall of the channel portion or cover hook and surrounds an annular bead of arcuate cross-section which extends away from the inner wall before turning to join a dependent substantially cylindrical wall portion which connects the center panel and ring to the deformable annulus.

An outer wall of the channel portion may have a peripheral cover hook for attachment to the flange of the side wall of a container body; or alternatively the outer wall of the channel portion may connect with the side wall of a can body drawn from a blank.

In another embodiment the deformable annulus is frutoconical and may, if desired, be provided with a plurality of stiffening beads which extend across its width to bias the deformable panel to either its original shape or its deformed shape.

In preferred embodiments the radial width of the deformable annulus is greater than the width of the channel portion. The channel portion preferably comprises an inner wall joined to an outer wall by a bead of arcuate cross-section typically or the order of 1.0 mm (about 0.004").

The inner wall and deformable panel are connected by a radius of the order of 0.7 mm (0.003"), at which bending takes place as the deformable annulus moves.

Various embodiments will now be described by way of example and with reference to the accompanying drawings in which.

Figure 1:
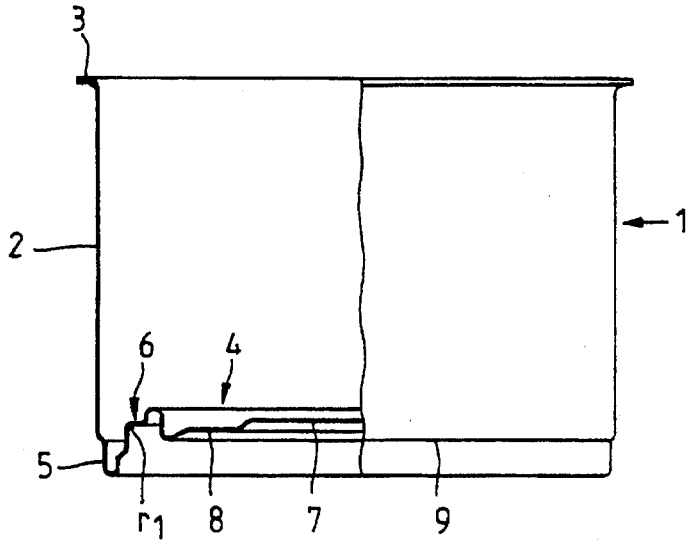
FIG. 1 is a part sectioned side view of a can body drawn from a sheet metal blank.
Figure 3:
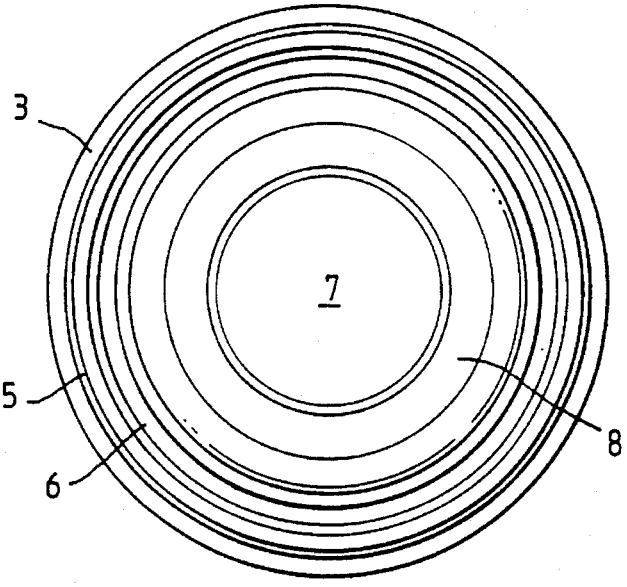
FIG. 3 is an underplan view of the can body of FIG. 1.

FIGS. 1 and 3 show a can body, 73 mm diameter×56 mm tall, drawn from a circular blank of lacquered electrochrome coated steel or tinplate 0.12 mm thick, comprising a cylindrical side wall 2 terminating at one end in an outwardly directed flange 3 and closed at the other end by an integral bottom wall 4. The bottom wall comprises a peripheral channel portion 5, a deformable annulus 6 and a central panel 7 surrounded by flexible expansion panels 8. The central panel 7 can be seen to be held at a level just above an optional stacking ledge 9 in FIG. 1.

Figure 2:
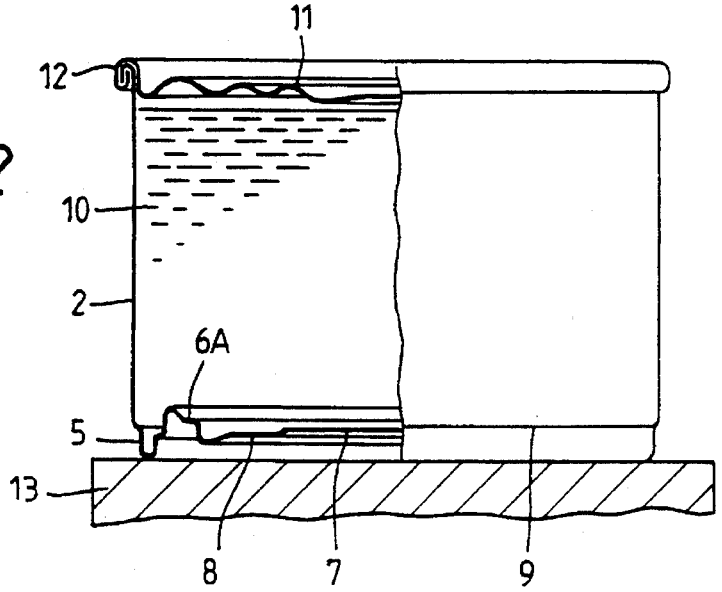
FIG. 2 is a like view of the can body of FIG. 1 after filling, closing, heating and cooling.

FIG. 2 shows the can body of FIG. 1 after filling with a product 10 and closing by a can end 11 attached to the flange of the body by a double seam 12. Under the influence of pressure arising during heating of this closed can to thermally process the product, the deformable annulus 6 has been deflected from the generally upward attitude shown in FIG. 1, by bending at radius $r_1$ to the generally downward attitude 6A shown in FIG. 2. Consequently the internal volume of the closed can body has been permanently increased by about 10 ml. However, the central panel 7 and its expansion rings continue to move under the influence of internal pressure in the can so that as the product cools and a partial vacuum develops, the center panel is pulled towards its original shape.

As shown in FIG. 2 the fully processed can is able to stand on a flat surface 13 with the central panel 7 just below the level of the stacking bead 9 but clear of the support surface 13.

Figure 4:
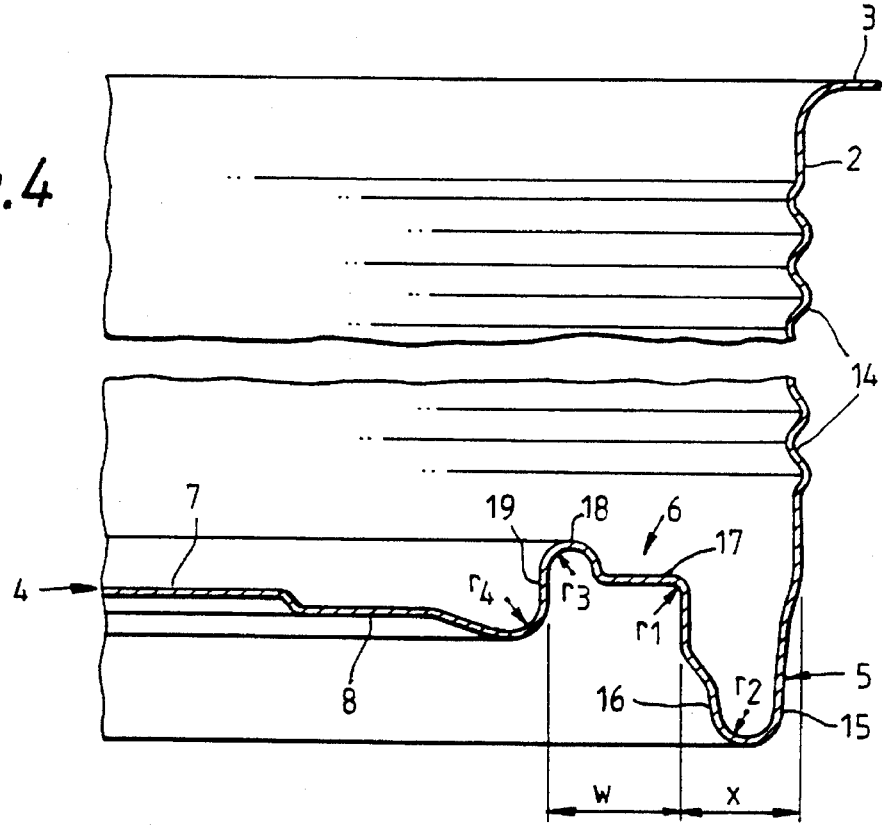
FIG. 4 is an enlarged fragmentary section of a preferred embodiment of the can body.

FIG. 4 shows a details of a preferred embodiment of the can body described with reference to FIG. 1. In FIG. 4, the side wall has been provided with a plurality of hoop beads 14 which stiffen the thin side wall metal against expansion or collapse so that the top end and bottom wall of the can have to provide movement to accommodate pressure change as the can and contents are thermally processed.

The channel portion 5 could usefully have an outer wall 15 coaxial with the side wall and a simple cylindrical inner wall 16 joined by an annular bead of arcuate cross-section radius $r_2$. However, as shown in FIG. 4, the outer wall 15 is of reduced diameter to permit stacking of the can body inside the double seam 12 of a lidded can, as shown in FIG. 2. The inner wall 16 is also stepped to give clearance for the pull tab of tear open can end (not shown) which may be required on some cans.

In FIG. 4, it will be seen that the deformable annulus 6 comprises a flat annular ledge 17 which surrounds an outwardly concave annular bead 18 of radius $r_3$ upstanding from the inner periphery of the ledge before it turns downwards to a dependent cylindrical wall portion 19 that joins the periphery of the periphery of the flexible panel 8 at a radius $r_4$. The flexible panel 8 and center panel 7 behave conventionally as will be understood in the art.

Typical dimensions for the bottom wall shown in FIG. 4 are:

| | | |
|---|---|---|
| $r_1$ | deformable annulus/inner wall | 0.1 mm |
| $r_2$ | stand bead radius | 0.8 mm |
| $r_3$ | radius of bead 18 | 0.75 mm |
| $r_4$ | dependent wall to flexible panel | 0.7 mm |
| w | radial width of deformable annulus | 5.0 mm |
| x | maximum width of cahnnel | 3.5 mm |

It will be noticed that the deformable annulus is wider than the channel portion so that it receives a greater pressure thrust force than the channel which is designed to remain stiff and unmoved.

Figure 5:
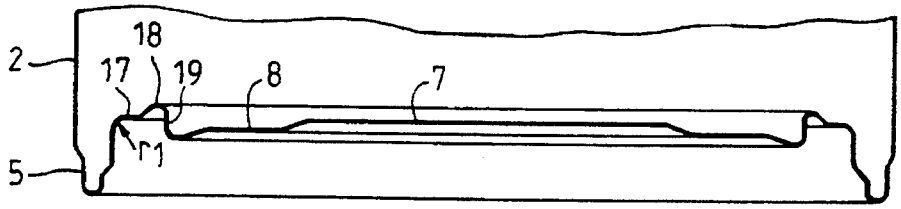
FIGS. 5, 6 and 7 are diagrammatic sectional views of the can bottom when empty, after filling and closing but during early heating of a thermal process, and after final cooling of the processed can to ambient temperature.
Figure 6:
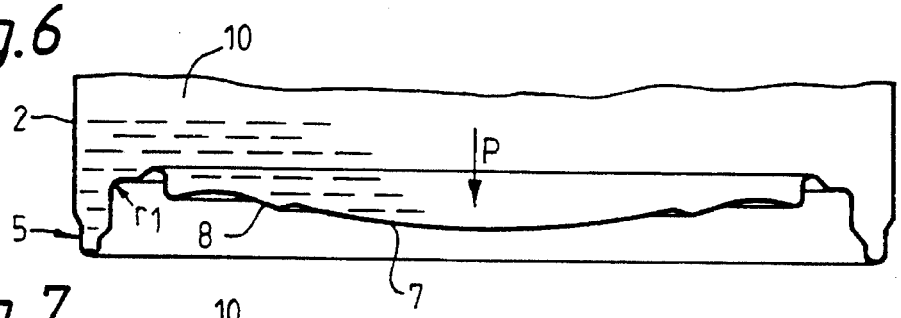
Figure 7:
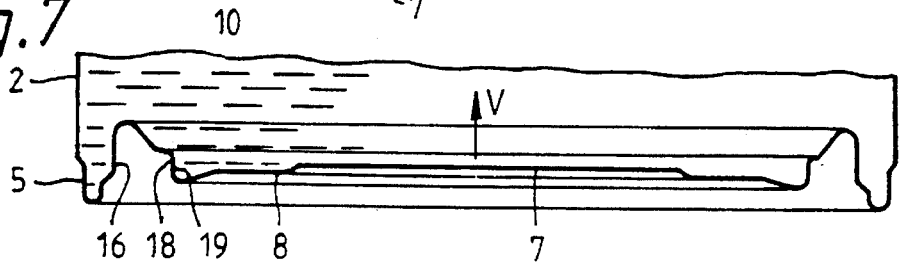
Figure 8:
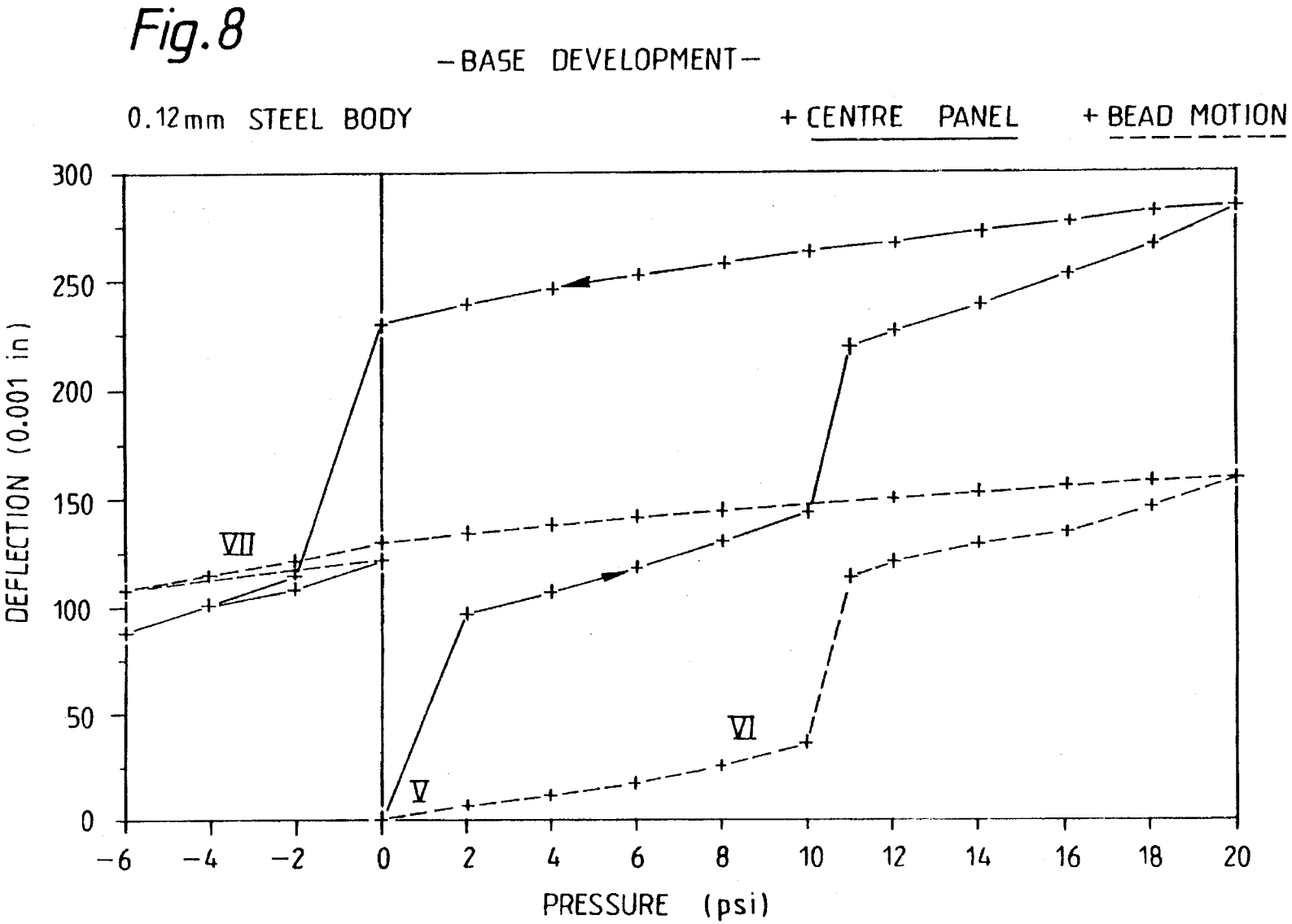
FIG. 8 is a graph of bottom wall deflection plotted against internal pressure in the closed can.

FIG. 5 is presented to show the bottom profile of the empty can body on a larger scale to permit comparison with FIGS 6 and 7, and understanding of the graph FIG. 8.

FIG. 6 shows the bottom wall 4 of the can body at an early stage in the heating of the filled and closed can. Expansion of the product 10 has increased pressure p in the can to distend the central panel 7 and flexible panel 8 so that the inner periphery of the deformable annulus 6 is subjected to a downward force.

FIG. 7 shows the bottom wall 4 after the processed can and contents have been cooled to ambient temperature and a partial vacuum V has developed to pull the center panel 7 and flexible ring 8 towards their original unpressurised shape. In FIG. 7, it can be seen that the deformable annulus 6 has hinged downwards at radius $r_1$, the flat ledge 17 has become approximately frustoconical to extend radially inwards and axially into the inner wall 16 and the radius $r_3$ has been opened out to almost a ledge so that the cylindrical wall portion 19 has moved to lower the central panel portions 7, 8 and create a permanent additional volume of about 10 ml.

In FIG. 8 the pressure inside the can during thermal processing is plotted against movement of the centre of the central panel 7 (full lines) and movement of the bead portion 18 of the deformable annulus (dashed lines). As pressure rises from atmospheric (denoted O) the centre panel starts to move quickly but the bead motion rises more slowly (see V on graphs indicating the shape shown in FIG. 5).

At about 10 psi overpressure in the can there is a sudden rise in both movement graphs (see VI denoting the can shape shown in FIG. 6) because the deformable panel starts to change shape rapidly and accommodate the increasing pressure in the can. In this trial, the maximum internal pressure was raised to 1.37 bar (20 psi) by which pressure the center panel was moved 0.275" (6.9 mm) and the bead 18 was moved 0.150" (3.7 mm). On cooling, the center of the can bottom returns to the shape of FIG. 7 denoted VII on the graph, with a resultant increase of 5% in contained volume (10 ml in 210 ml).

The benefit arising from this increase in container volume is that the thin side wall and end components are protected from pressure which may reform or burst them. Therefore, it is possible to use thinner container materials. The thinner wall material may, if desired, be reinforced by hoop panelling as described or made expandable by vertical panels designed to flex inwards and outwards, if desired.

Figure 9:
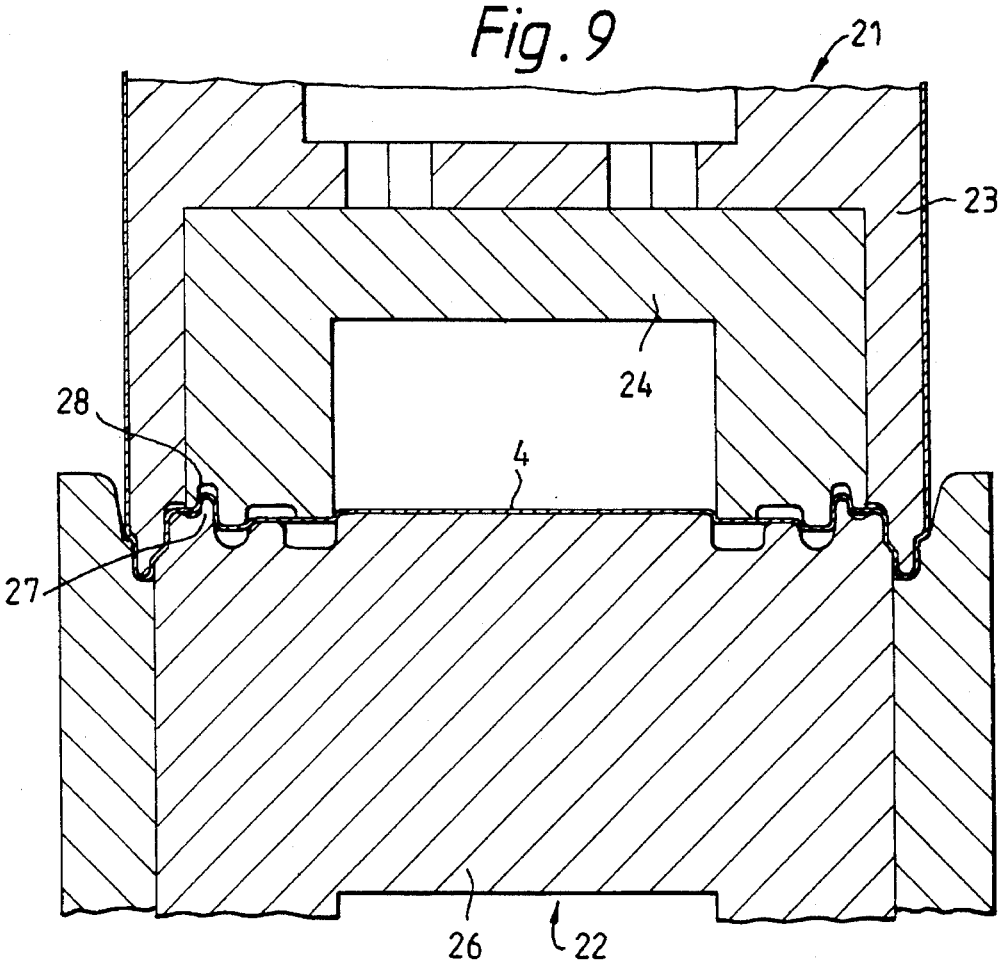
FIG. 9 is a diagrammatic sketch of a press tool with formed can body.

FIG. 9 shows a press tool 20 in which the bottom wall 4 of the can body 1 is formed between an upper tool 21 and a lower tool 22. The upper tool comprises a sleeve 23 which surrounds a center pad 24. The lower tool comprises an annular die 25 which surrounds a punch 26. The radius between the inner wall 16 and deformable annulus 6 are formed by closing of the tools 21, 22 together. In order to achieve the desired value of radius $r_1$ and $r_2$ an annular punch bead 27 pushes metal into center pad groove 28 to pull the metal tight so that, on parting of the tools 21, 22 the radii 21, 22 are correctly defined.

Figure 10:
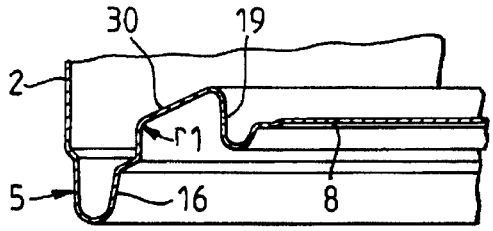
FIG. 10 is a fragmentary section of a first alternative embodiment of an end wall profile.

FIG. 10 shows an alternative shape for the deformable annulus in which the flat ledge 17 and bead 18 are replaced by an upwardly and inwardly extending frustoconical portion 30. In other respects the bottom wall is similar to the bottom wall shown in FIG. 4 so the same integer numbers are used to denote the dependent wall 19 and inner wall 16 of the channel.

Figure 11:
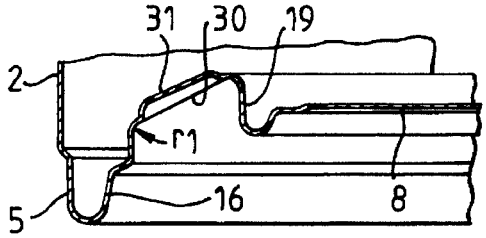
FIG. 11 is a fragmentary section of the end wall of FIG. 10 with additional beads.

FIG. 11 shows a modified form of the wall of FIG. 10 in which the frustoconical deformable annulus 30 is provided with a plurality of equispaced hollow beads 31 to stiffen the annulus and encourage it to suddenly evert from the upwardly inclined shape to a downwardly inclined shape as pressure in the can rises.

Figure 12:
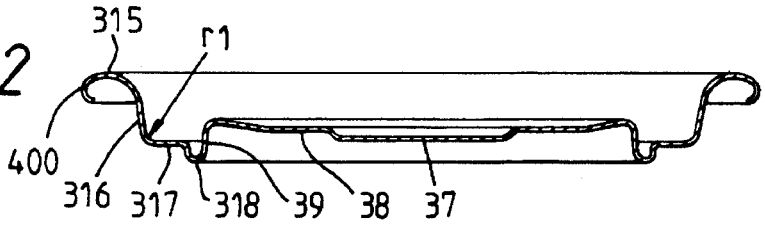
FIG. 12 is a side view of a can end sectioned on a diameter.

FIG. 12 shows a can end suitable for fixing to a can body by means of a double seam. This can end uses the principles hereinbefore discussed to provide a permanent increase in container volume during thermal processing.

In FIG. 12 the can end comprises a flat central panel 37, an annular expansion ring 38 surrounding the central panel, an annular wall 39 depending from the periphery of the expansion ring 38, an outwardly concave bead 318 which turns outwardly from the annular wall, an annular ledge 317 extending outwardly from the bead 318, an inner wall 316 of a channel portion 315, which extends to a peripheral cover hook 400.

The annular ledge 317 and bead 318 behave in the manner described above under the influence of pressures arising during thermal processing of a filled can so that this can end may be used to protect the thin side wall or ends of a can having a side seam or made by deep drawing of a blank. This can end may, if desired, provide volume change additional to that available from a similarly profiled can bottom.

We claim:

1. A container end wall (4) comprising a peripheral channel portion opening in an axially upward direction and being defined by an outer wall (15) an inner wall (16) and an annular bead therebetween; a center panel (7) spaced radially inboard of said inner wall (16), an inner peripheral wall (19) joined to said center panel, a deformable bistable annulus (6) extending both radially and axially inward away from said inner wall (16) and being joined to said inner peripheral wall (19), and said deformable bistable annulus (6) being constructed and arranged to (a) occupy a first stable position under ambient pressure at which said centre panel (7) and said deformable bistable annulus (6) are undeflected, and (b) occupy a second bistable position under internal pressure above ambient pressure at which said centre panel (7) is temporarily deflected axially upward and said deformable bistable annulus (6) is permanently deflected from its first stable position to a second stable position which permanently increases the volume of the container.

2. The container end wall as defined in claim 1 wherein said centre panel (7) includes a central panel portion surrounded by at least one flexible annular expansion panel (8) which is connected to said deformable bistable annulus (6) by said inner peripheral wall (19) which is substantially stiff and of a generally cylindrical configuration.

3. The container end wall as defined in claim 1 wherein said deformable bistable annulus (6) in its first stable position includes a substantially flat annular portion (17) extending radially inward from said inner wall (16) and merges with an annular axially outwardly opening bead (18), and said annularly axially outwardly opening bead (18) further merges with said peripheral wall (19).

4. The container end wall as defined in claim 1 wherein said outer wall (15) merges with a drawn can body side wall.

5. The container end wall as defined in claim 1 wherein said deformable bistable annulus (16) is disposed in a generally radial plane.

6. The container end wall as defined in claim 1 wherein said deformable bistable annulus (30) is disposed in a generally frusto-conical plane.

7. The container end wall as defined in claim 1 wherein said deformable bistable annulus (30) is disposed in a generally frusto-conical plane, and said frusto-conically disposed deformable bistable annulus (30) includes a plurality of stiffening beads (31) extending across its width.

8. The container end wall as defined in claim 1 wherein the radial width of said deformable bistable annulus (6) is greater than the radial width of said channel portion.

9. The container end wall as defined in claim 1 wherein said deformable bistable annulus (6) is joined to said inner wall (16) by a radius (r1) of substantially 1.0 mm.

10. The container end wall as defined in claim 1 wherein said deformable bistable annulus (6) in its first stable position includes a substantially flat annular portion (17) extending radially inward from said inner wall (16) and merges with an annular axially outwardly opening bead (18), said annularly axially outwardly opening bead (18) further merges with said peripheral wall (19), and said annular bead (18) has a radius of curvature of substantially 0.75 mm.

11. A container end comprising a cover hook (315) merging radially inboard with an inner wall (316), a centre panel (37) spaced radially inboard of said inner wall (316), an inner peripheral wall (39) joined to said centre panel, a deformable bistable annulus (317, 318) extending both radially and axially inward away from said inner wall (316) and being joined to said inner peripheral wall (39), and said deformable bistable annulus (317, 318) being constructed and arranged to (a) occupy a first stable position under ambient pressure at which said centre panel (37) and said deformable bistable annulus (317, 318) are undeflected, and (b) occupy a second bistable position under internal pressure above ambient pressure at which said centre panel (37) is temporarily deflected axially upward and said deformable bistable annulus (317, 318) is permanently deflected from its first stable position to a second stable position which permanently increases the volume of a container with which the container end is adapted to be secured by said cover hook (315).

12. The container end as defined in claim 11 wherein said centre panel (37) includes a central panel portion surrounded by at least one flexible annular expansion panel (38) which is connected to said deformable bistable annulus (317, 318) by said inner peripheral wall (39) which is substantially stiff and of a generally cylindrical configuration.

13. The container end as defined in claim 11 wherein said deformable bistable annulus (317, 318) in its first stable position includes a substantially flat annular portion (317) extending radially inward from said inner wall (316) and merges with an annular axially outwardly opening bead (318), and said annularly axially outwardly opening bead (318) further merges with said peripheral wall (319).

14. The container end as defined in claim 11 wherein said cover hook (315) is adapted to be seamed to a drawn can body side wall.

15. The container end as defined in claim 11 wherein said deformable bistable annulus (317, 318) is disposed in a generally radial plane.

16. The container end as defined in claim 11 wherein the radial width of said deformable bistable annulus (317, 318) includes a substantially flat annular portion which is greater in radial length than the radial width of said channel portion.

17. The container end as defined in claim 11 wherein said deformable bistable annulus (317, 318) is joined to said inner wall (316) by a radius (r1) of substantially 1.0 mm.

18. The container end as defined in claim 11 wherein said deformable bistable annulus (317, 318) in its first stable position includes a substantially flat annular portion (317) extending radially inward from said inner wall (316) and merges with an annular axially outwardly opening bead (318), said annularly axially outwardly opening bead (318) further merges with said peripheral wall (39), and said annular bead (318) has a radius of curvature of substantially 0.75 mm.

* * * * *